US010773294B2

(12) United States Patent
Chu et al.

(10) Patent No.: US 10,773,294 B2
(45) Date of Patent: Sep. 15, 2020

(54) CLAMPING MECHANISM

(71) Applicant: METAL INDUSTRIES RESEARCH & DEVELOPMENT CENTRE, Kaohsiung (TW)

(72) Inventors: Hsin-Wei Chu, Pingtung County (TW); Pin-Jyun Chen, Kaohsiung (TW); Ching-Hua Hsieh, Kaohsiung (TW); Hui-Chi Chang, Kaohsiung (TW); Po-Fu Hsu, Kaohsiung (TW); Chien-Fa Huang, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 160 days.

(21) Appl. No.: 16/218,634

(22) Filed: Dec. 13, 2018

(65) Prior Publication Data

US 2020/0188984 A1 Jun. 18, 2020

(51) Int. Cl.

| | |
|---|---|
| ***B21D 28/34*** | (2006.01) |
| ***B25B 5/06*** | (2006.01) |
| ***B21D 28/14*** | (2006.01) |

(52) U.S. Cl.
CPC ..... *B21D 28/34* (2013.01); *B21D 28/14* (2013.01); *B25B 5/061* (2013.01)

(58) Field of Classification Search
CPC combination set(s) only.
See application file for complete search history.

(56) References Cited

U.S. PATENT DOCUMENTS 5,326,186 A * 7/1994 Nyberg ..... B64G 1/641 403/325
6,868,912 B2 * 3/2005 Proctor ..... E21B 43/128 166/105

* cited by examiner

*Primary Examiner* — Daniel J Wiley
(74) *Attorney, Agent, or Firm* — Jackson IPG PLLC; Demian K. Jackson

(57) ABSTRACT

A clamping mechanism is provided to clamp a die set on a carrier of a machine. The clamping mechanism utilizes a first pushing block to push a locating shaft of the die set to allow a top surface of the locating shaft to contact a mounting surface of the carrier and utilizes a second pushing block to push the locating shaft to allow a first contacting surface of the locating shaft to contact a reference surface of a cage base such that the die set will not clamp on the carrier of the machine with shift or skew errors.

13 Claims, 11 Drawing Sheets

CLAMPING MECHANISM

FIELD OF THE INVENTION

This invention generally relates to a clamping mechanism, and more particularly to a clamping mechanism able to clamp and fix a locating shaft of a die set on a machine.

BACKGROUND OF THE INVENTION

Dies (e.g. upper and lower dies) mounting on machine and die tools correction are required in mechanical processing in order to prevent die damages caused by shifted or skew die tools during processing.

In conventional mechanical punching steps, different punching dies are replaced and unloaded from a machine automatically for small-volume production of a wide range of different items. Although the time for die replacement is saved, the die may be fixed on the machine with shift or skew errors. As a result, the die tools in the dies may be easily impact with each other during automatic punching so as to lead die damages or insufficient production.

SUMMARY

One object of the present invention is to provide a clamping mechanism able to avoid a die set mounted on a machine with shift or skew errors.

The clamping mechanism of the present invention is coupled to a carrier of a machine and provided to clamp a locating shaft of a die set. The locating shaft includes a first pushed portion and a second pushed portion oppositely located on the locating shaft surface. The clamp mechanism includes a cage base, a first pushing block and a second pushing block. The cage base is fixed on the carrier and includes a reference portion, a first guide portion, a second guide portion and an accommodation space. The first and second guide portions are located on both sides of the reference portion respectively, and the accommodation space provided to accommodate the locating shaft is located between the first and second guide portions. There is a first guide opening on the first guide portion and a second guide opening on the second guide portion, the first and second guide openings communicate with the accommodation space respectively. The first pushing block is movably disposed in the first guide opening and includes a first pushing portion. The pushing portion is provided to push a first horizontal pushed surface of the first pushed portion of the locating shaft to allow a top surface of the locating shaft to contact against a mounting surface of the carrier. The second pushing block is movably disposed in the second guide opening and includes a second pushing portion. The second pushing portion is provided to push a first vertical pushed surface of the second pushed portion of the locating shaft to allow a first contacting surface of the locating shaft to contact against a first reference surface of the reference portion.

When the locating shaft of the die set is mounted in the accommodation space of the cage base, the clamping mechanism utilizes the first and second pushing blocks to clamp the locating shaft such that the top surface of the locating shaft contacts against the mounting surface of the carrier and the first contacting surface of the locating shaft contacts against the first reference surface of the reference portion. Accordingly, the die set fixed on the carrier will not shift or skew.

DETAILED DESCRIPTION OF THE INVENTION

Figure 1:
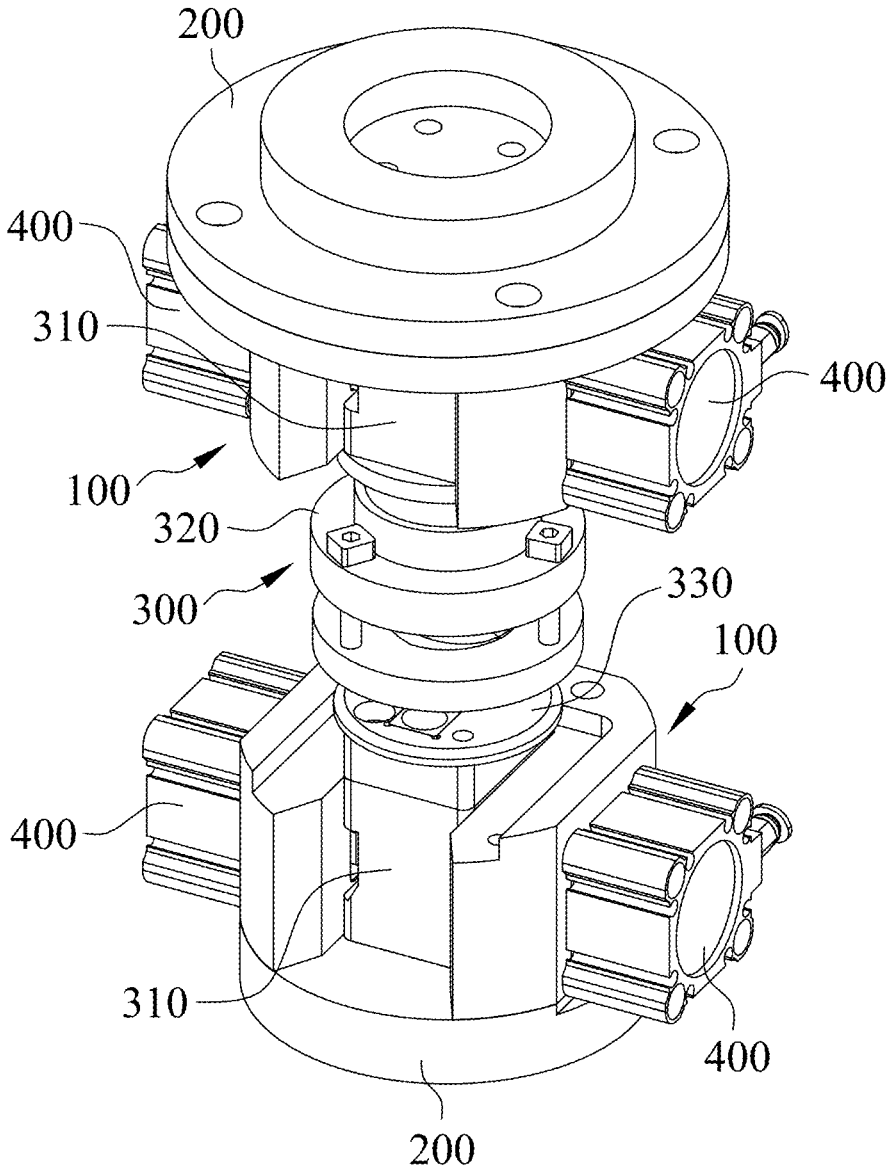
FIG. 1 is a perspective assembly diagram illustrating a clamping mechanism coupled to a carrier in accordance with an embodiment of the present invention.
Figure 2:
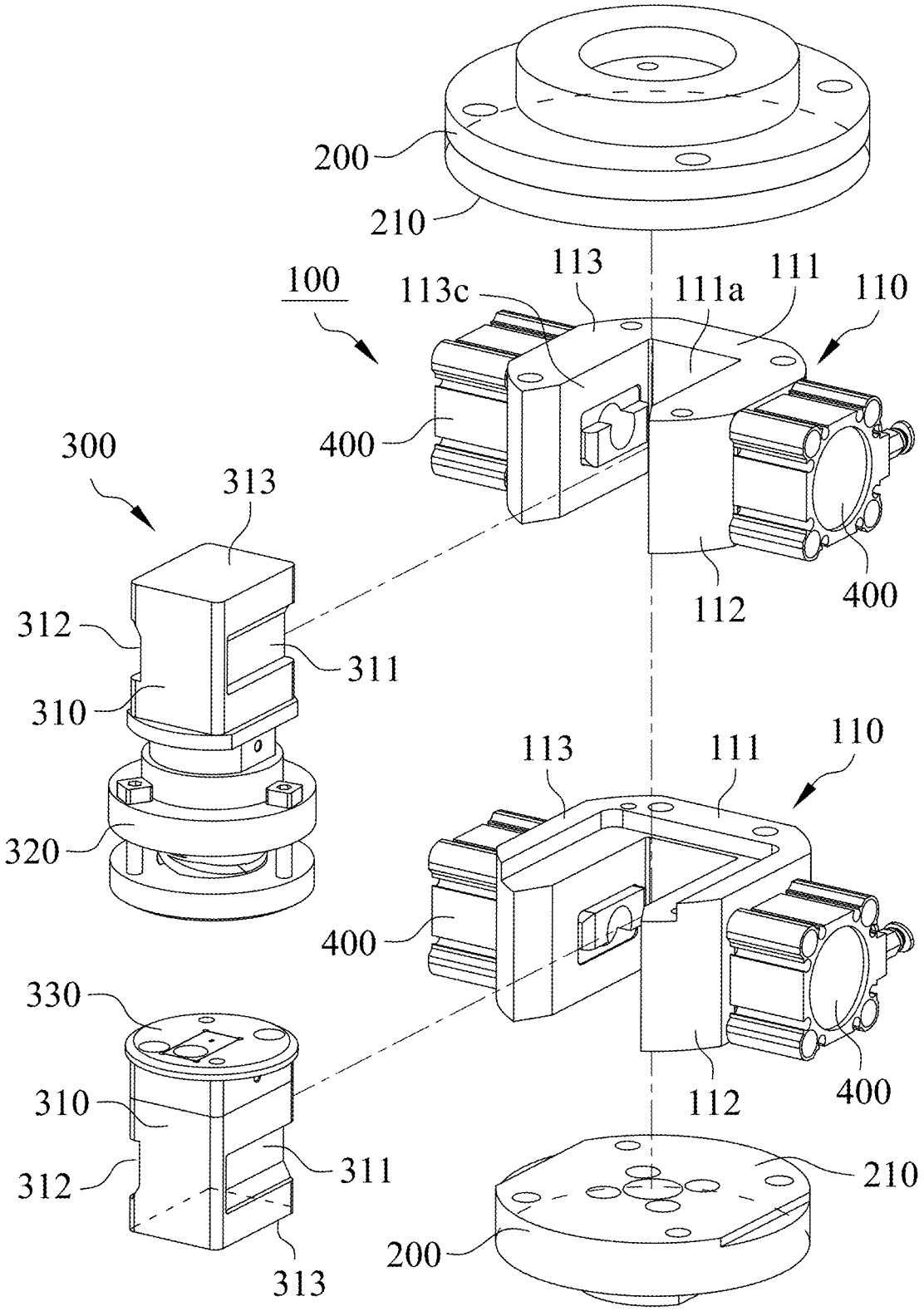
FIG. 2 is a perspective exploded diagram illustrating the clamping mechanism coupled to the carrier in accordance with an embodiment of the present invention.

With reference to FIGS. 1 and 2, a clamping mechanism 100 of the present invention mounted in a machine, such as, but not limited to, a punching machine (not shown) is connected to a carrier 200 of the machine and provided to clamp a locating shaft 310 of a die set 300. The locating shaft 310 includes a first pushed portion 311 and a second pushed portion 312 which are oppositely located and recessed on a surface of the locating shaft 310 for clamping the die set 300 stably. The dies set 300 is, but not limited to, a punching die having an upper die 320 and a lower die 330. The locating shaft 310 may be connected to the upper die 320 or the lower die 330, or two locating shafts 310 are connected to the upper die 320 and the lower die 330 respectively.

Figure 3:
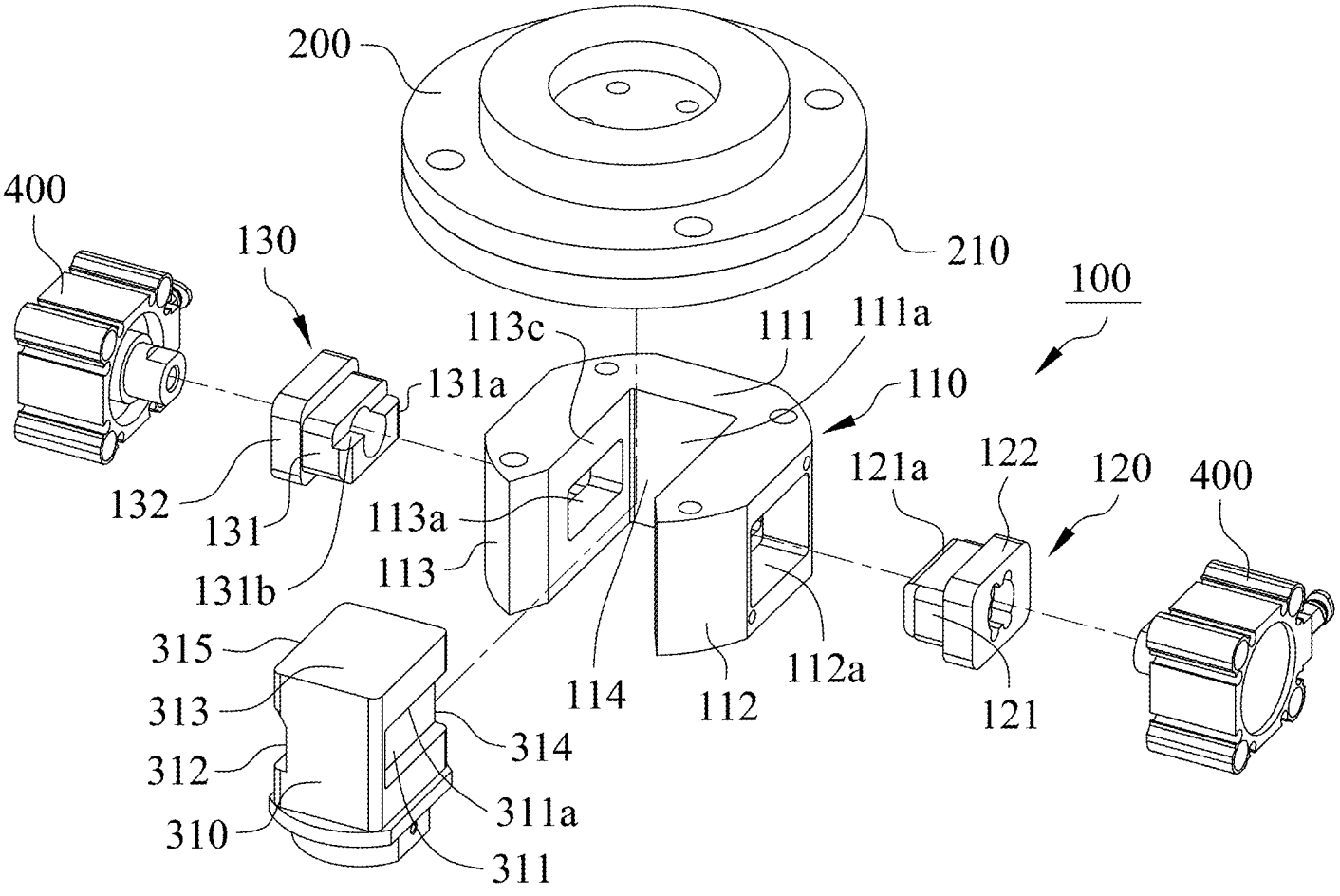
FIG. 3 is a perspective exploded diagram illustrating the clamping mechanism in accordance with an embodiment of the present invention.

With reference to FIGS. 2 and 3, the clamping mechanism 100 provided to clamp the upper die 320 will be described below. The clamping mechanism 100 includes a cage base 110, a first pushing block 120 and a second pushing block 130. The cage base 110 is coupled to the carrier 200, and in this embodiment, the cage base 110 is fixed on a mounting surface 210 of the carrier 200. The cage base 110 includes a reference portion 111, a first guide portion 112, a second guide portion 113 and an accommodation space 114.

Figure 4:
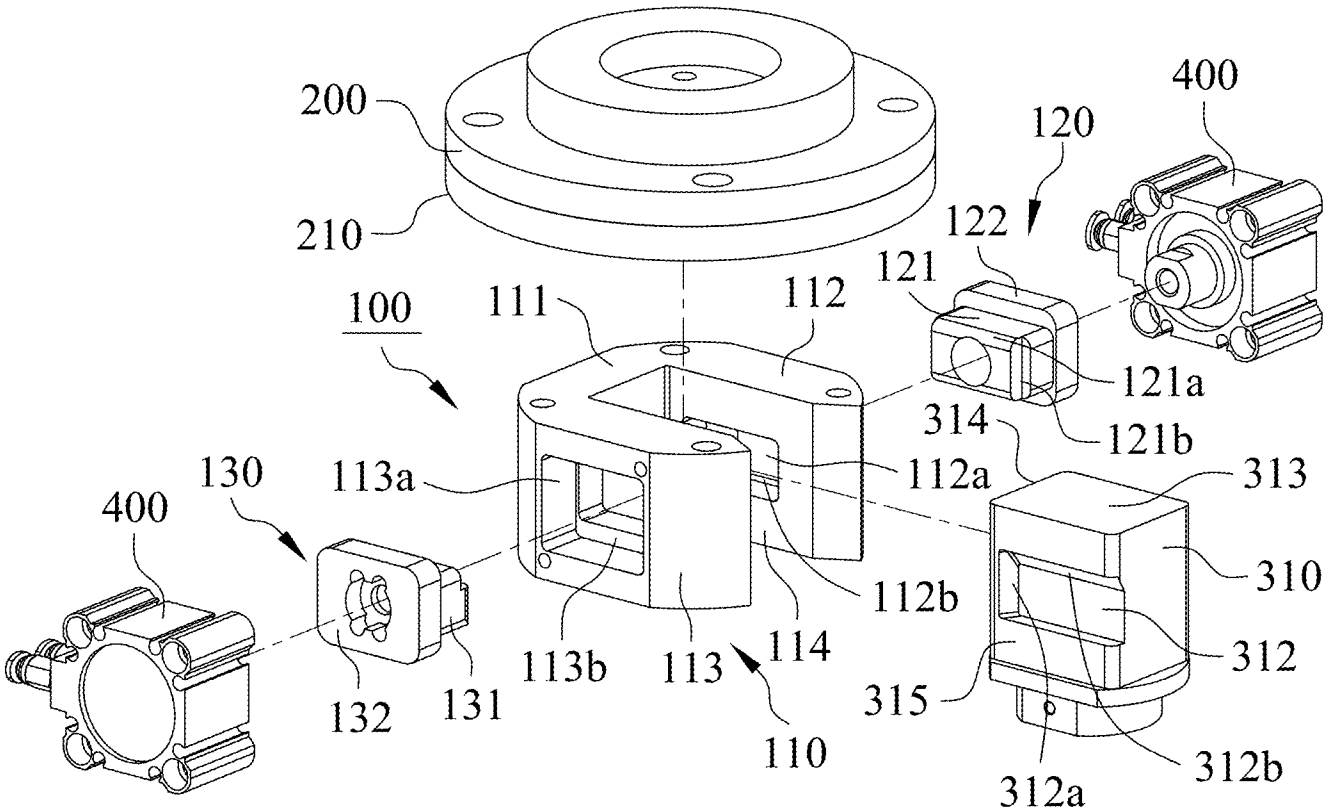
FIG. 4 is a perspective exploded diagram illustrating the clamping mechanism in accordance with an embodiment of the present invention.

With reference to FIGS. 2, 3 and 4, the first guide portion 112 and the second guide portion 113 are located on both sides of the reference portion 111 respectively, and the accommodation space 114 is located between the first guide portion 112 and the second guide portion 113. The first guide portion 112 has a first guide opening 112*a* and the second guide portion 113 has a second guide opening 113*a*. Referring to FIGS. 4 to 7, there is a first blocking flange 112*b* in the first guide opening 112*a* and a second blocking flange 113*b* in the second guide opening 113*a*. The first guide opening 112*a* and the second guide opening 113*a* are respectively communicating with the accommodation space 114 which is provided to accommodate the locating shaft 310.

With reference to FIGS. 1 to 4, the first pushing block 120 is movably disposed in the first guide opening 112*a*. In this embodiment, the first pushing block 120 is able to be moved toward or away from the accommodation space 114 by a power 400, and the power 400 may be pneumatic cylinder, hydraulic cylinder or motor.

With reference to FIGS. 3 to 9, the first pushing block 120 has a first pushing portion 121 used to push the locating shaft 310 and a first restricting portion 122. In this embodiment, the first pushing block 120 is moved by the power 400 to allow the first pushing portion 121 to press on the first pushed portion 311 of the locating shaft 310, and the first blocking flange 112*b* in the first guide opening 112*a* is provided to block the first restricting portion 122 of the first pushing block 120 so as to prevent the damage to the first pushing block 120 or the locating shaft 310 caused by the first pushing block 120 over-pushing the locating shaft 310.

Figure 6:
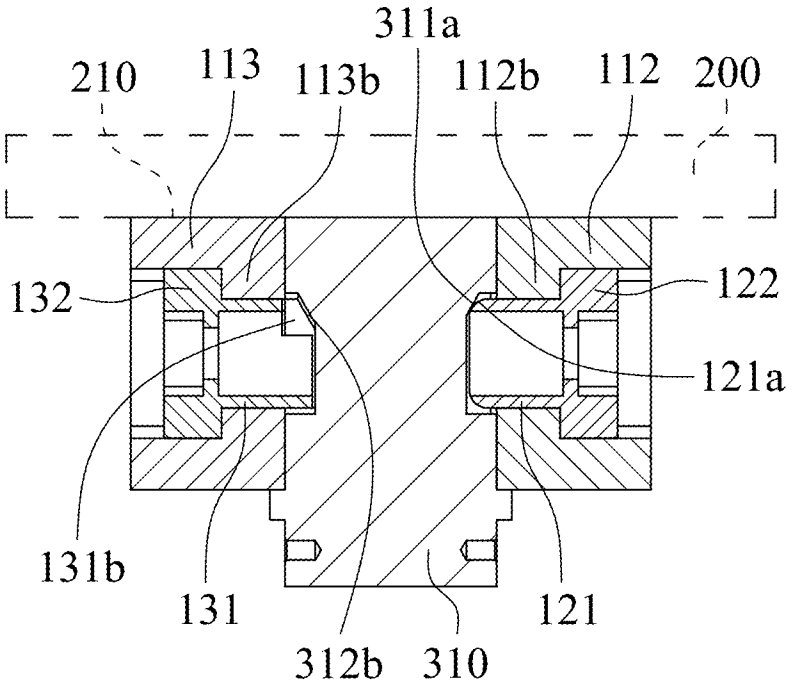
FIG. 6 is a cross-sectional diagram illustrating the clamping mechanism clamping the locating shaft in accordance with an embodiment of the present invention.
Figure 5:
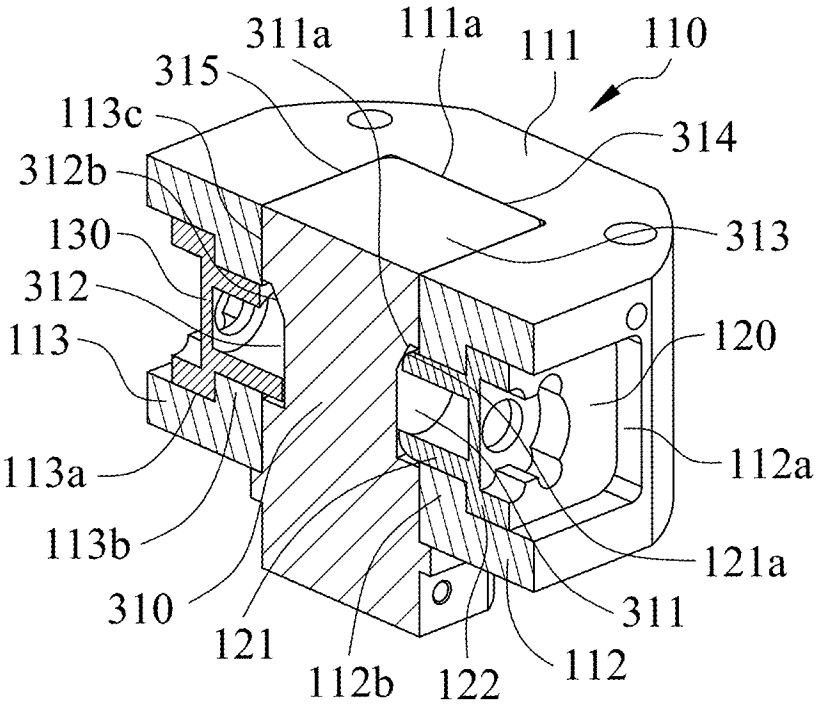
FIG. 5 is a cross-sectional perspective diagram illustrating the clamping mechanism clamping a locating shaft in accordance with an embodiment of the present invention.
Figure 8:
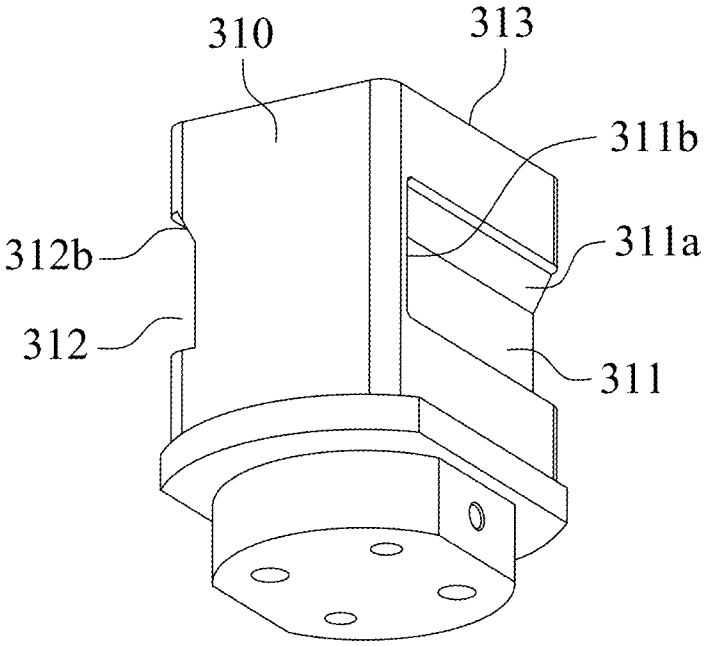
FIG. 8 is a perspective diagram illustrating the locating shaft.
Figure 7:
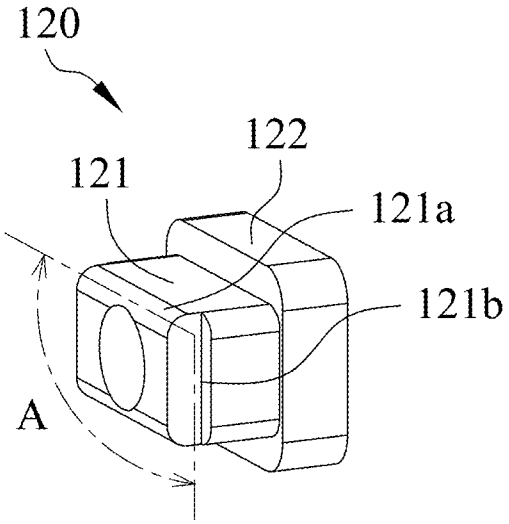
FIG. 7 is a perspective diagram illustrating a first pushing block of the clamping mechanism in accordance with an embodiment of the present invention.

With reference to FIGS. 5 to 9, the first pushing portion 121 can push a first horizontal pushed surface 311*a* of the first pushed portion 311 of the locating shaft 310 such that a top surface 313 of the locating shaft 310 contacts against the mounting surface 210 of the carrier 200. Preferably, there is a first pushing curved surface 121*a* on the first pushing portion 121, and the first horizontal pushed surface 311*a* is an inclined surface. Referring to FIGS. 5 and 6, the first pushing portion 121 can utilize the first pushing curved surface 121*a* to push the first horizontal pushed surface 311*a* so as to move the locating shaft 310 toward the carrier 200 and allow the top surface 313 of the locating shaft 310 to contact against the mounting surface 210 of the carrier 200. Particularly, the locating shaft 310 is also moved toward the second guide portion 113 to allow a second contacting surface 315 of the locating shaft 310 to contact against a second reference surface 113*c* of the second guide portion 113 when the first pushing portion 121 pushes the first horizontal pushed surface 311*a*.

With reference to FIGS. 3 and 4, the second pushing block 130 is movably disposed in the second guide opening 113*a*, and in this embodiment, the second pushing block 130 can be moved toward or away from the accommodation space 114 by another power 400. The power 400 also may be pneumatic cylinder, hydraulic cylinder or motor.

With reference to FIGS. 3, 4, 9 to 11, there are a second pushing portion 131 and a second restricting portion 132 on the second pushing block 130, and the second pushing portion 131 is provided to push the locating shaft 310. The second pushing block 130 in this embodiment is moved by the power 400 to allow the second pushing portion 131 to press the second pushed portion 312 of the locating shaft 310. Furthermore, the second blocking flange 113*b* in the second guide opening 113*a* can block the second restricting portion 132 of the second pushing block 130 such that the second pushing block 130 will not over push the locating shaft 310 and damages on the second pushing block 130 and the locating shaft 310 are avoidable.

Figure 9:
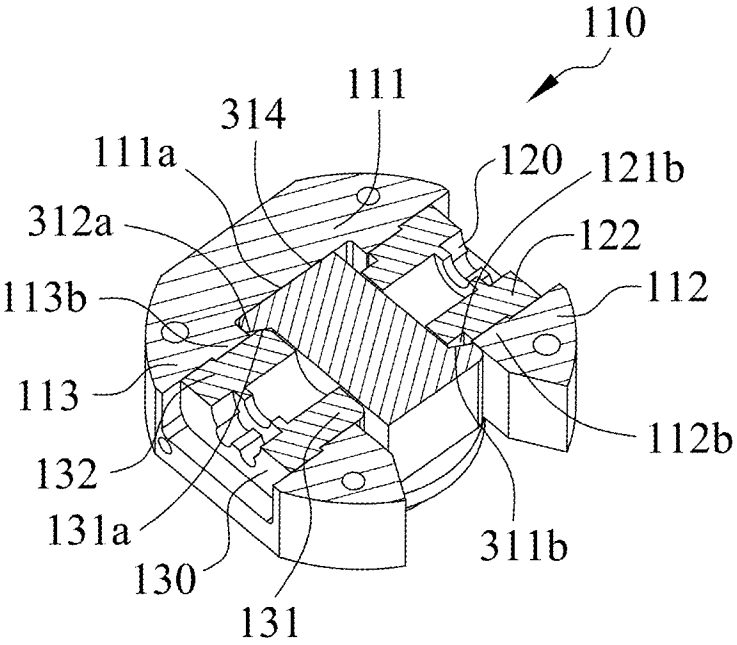
FIG. 9 is a cross-sectional perspective diagram illustrating the clamping mechanism clamping the locating shaft in accordance with an embodiment of the present invention.
Figure 11:
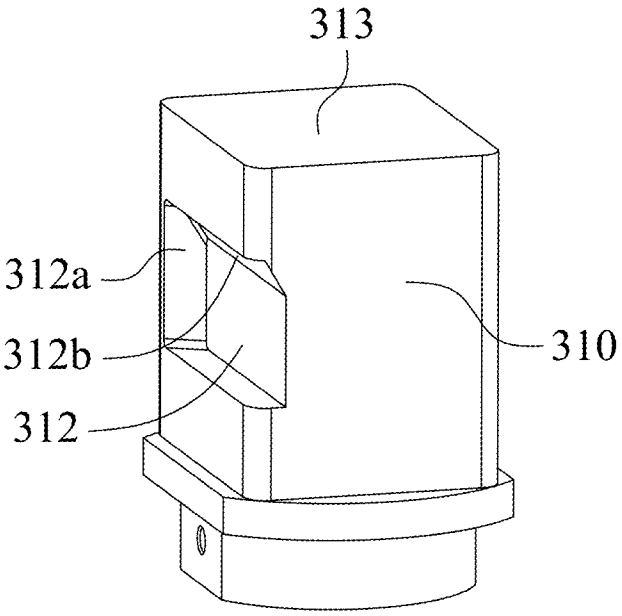
FIG. 11 is a perspective diagram illustrating the locating shaft.
Figure 10:
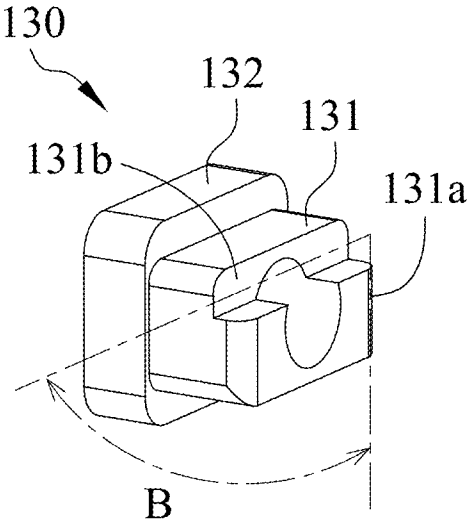
FIG. 10 is a perspective diagram illustrating a second pushing block of the clamping mechanism in accordance with an embodiment of the present invention.
Figure 12:
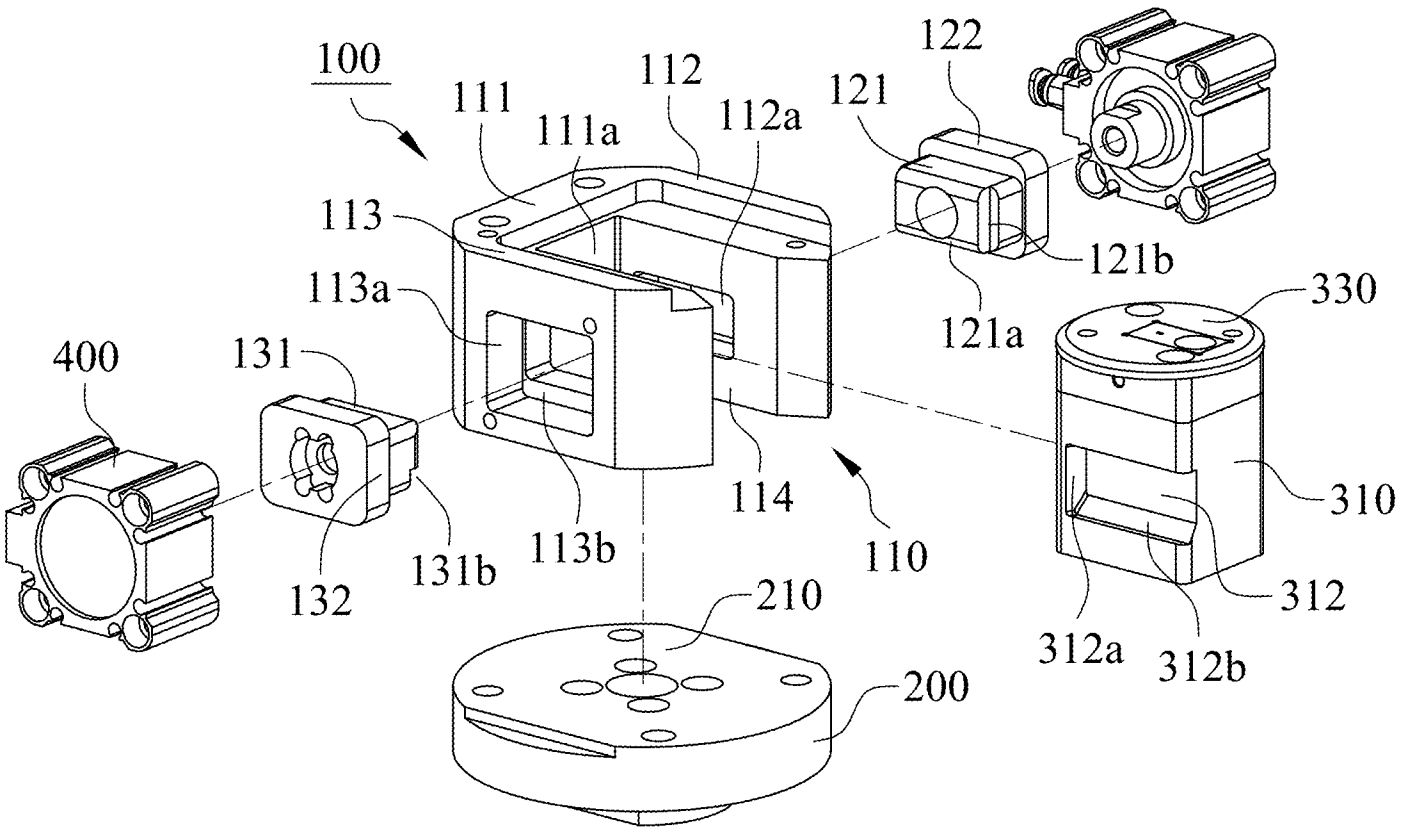
FIG. 12 is a perspective exploded diagram illustrating the clamping mechanism coupled to the carrier in accordance with an embodiment of the present invention.
Figure 13:
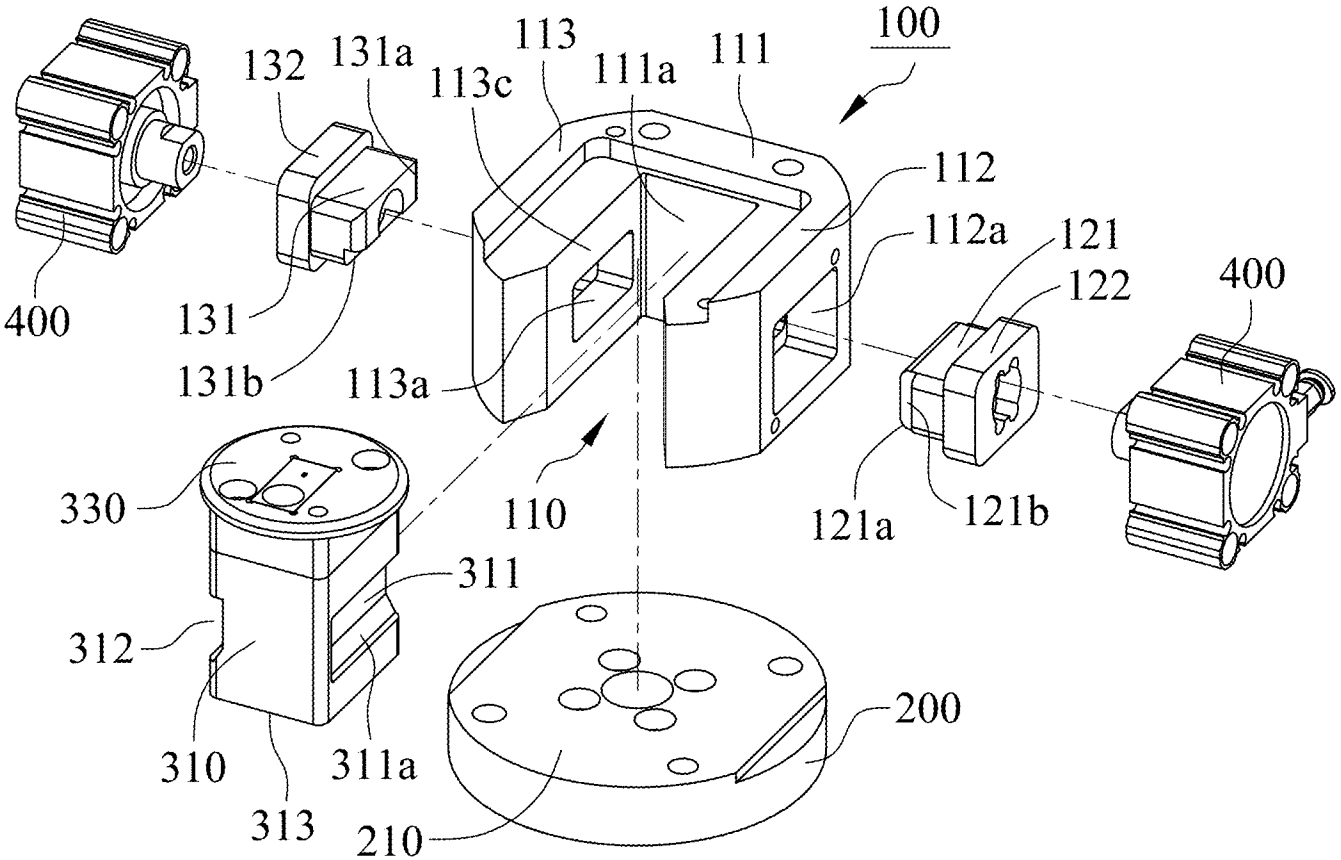
FIG. 13 is a perspective exploded diagram illustrating the clamping mechanism coupled to the carrier in accordance with an embodiment of the present invention.

With reference to FIGS. 9 to 11, the second pushing portion 131 can push a first vertical pushed surface 312*a* of the second pushed portion 312 of the locating shaft 310 to lead a first contacting surface 314 of the locating shaft 310 contacting against a first reference surface 111*a* of the reference portion 111. Particularly, the second pushing portion 131 has a second pushing curved surface 131*a* and the first vertical pushed surface 312*a* is an inclined surface, as a result, the second pushing portion 131 can push the first vertical pushed surface 312*a* by the second pushing curved surface 131*a* to move the locating shaft 310 toward the reference portion 111 and lead the first contacting surface 314 of the locating shaft 310 to contact against the first reference surface 111*a* of the reference portion 111.

With reference to FIGS. 2, 5 and 9, the first pushing block 120 and the second pushing block 130 are provided to clamp the locating shaft 310 integrated with the upper die 320 so that the locating shaft 310 can contact against the mounting surface 210 of the carrier 200, the second reference surface 113*c* of the second guide portion 113 and the first reference surface 111*a* of the reference portion 111 to prevent shift or skew errors of the locating shaft 310 and the die set 300 on the carrier 200. Consequently, impact between adjacent die tools in the die set or defective production will not occur during automatic punching steps.

With reference to FIGS. 3, 4, 8, 9 and 11, in order to mount the locating shaft 310 in distinct dies without directional limitation, the first pushed portion 311 is designed to have a second vertical pushed surface 311*b* and the second pushed portion 312 is designed to have a second horizontal pushed surface 312*b*. In other words, both of the first pushed portion 311 and the second pushed portion 312 have one horizontal pushed surface and one vertical pushed surface.

With reference to FIGS. 4, 7 to 9, there is preferably a vertical relief groove 121*b* on the first pushing portion 121 for the second vertical pushed surface 311*b* of the locating shaft 310, and there is a first included angle A (shown in FIG. 7) defined between the vertical relief groove 121*b* and time first pushing curved surface 121*a*. When the first pushing curved surface 121*a* pushes the first horizontal pushed surface 311*a*, the vertical relief groove 121*b* is provided to accommodate the second vertical pushed surface 311*b* on the first pushed portion 311 so as to prevent the first pushing portion 121 from impacting the second vertical pushed surface 311*b*, that protect the locating shaft 310 and the first pushing portion 120 from damages.

With reference to FIGS. 3, 4, 5, 10 and 11, the second pushing portion 131 may have a horizontal relief groove 131*b* for the second horizontal pushed surface 312*b* of the locating shaft 310. As shown in FIG. 10, a second included angle B is defined between the horizontal relief groove 131*b* and the second pushing curved surface 131*a*. In order to prevent the second pushing portion 131 from impacting the second horizontal pushed surface 312*b*, the horizontal relief groove 131*b* is designed to accommodate the second horizontal pushed surface 312*b* of the second pushed portion 312 when the second pushing curved surface 131*a* pushes the first vertical pushed surface 312*a*. Accordingly, the damage on the locating shaft 310 or the second pushing block 130 is preventable.

Preferably, the first include angle A is substantially equal to the second include angle B for fitting the locating shaft 310. In addition, the vertical relief groove 121*b* is substantially perpendicular to the first pushing curved surface 121*a* and the horizontal relief groove 131*b* is substantially perpendicular to the second pushing curved surface 131*a*.

With reference to FIGS. 12 to 15, the clamping mechanism 100 provided to clamp the lower die 330 will be described below. The cage base 110 is fixed on the carrier 200. The first pushing block 120 can push the first horizontal pushed surface 311*a* of the locating shaft 310 to move the locating shaft 310 toward the carrier 200, lead the top surface 313 of the locating shaft 310 to contact the mounting surface 210 of the carrier 200 and lead the second contacting surface 315 of the locating shaft 310 to contact the second reference surface 113*c* of the second guide portion 133. The second pushing block 130 can push the first vertical pushed surface 312*a* of the locating shaft 310 to move the locating shaft 310 toward the reference portion 111 and allow the first contacting surface 314 of the locating shaft 310 to contact the first reference surface 111*a* of the reference portion 111.

Figure 15:
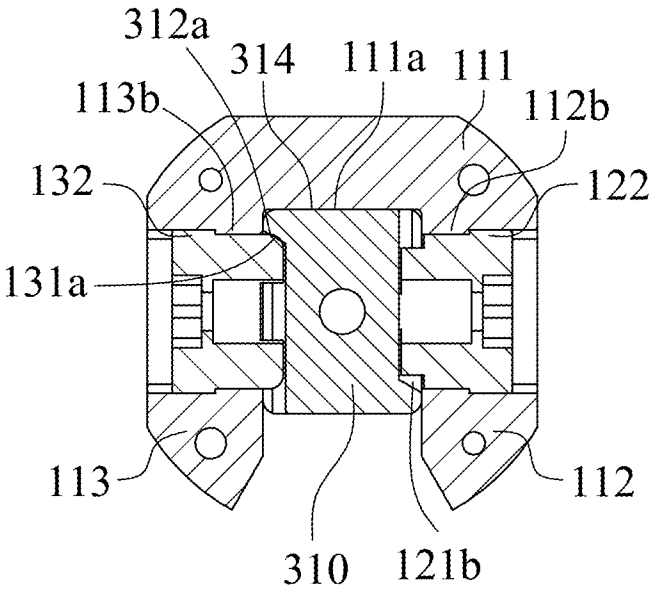
FIG. 15 is a cross-sectional diagram illustrating the clamping mechanism clamping the locating shaft in accordance with an embodiment of the present invention.
Figure 14:
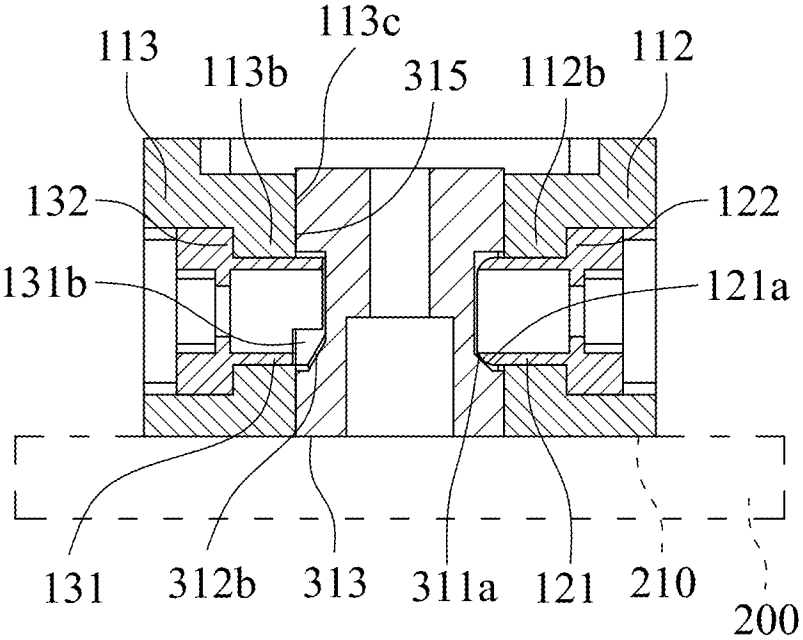
FIG. 14 is a cross-sectional diagram illustrating the clamping mechanism clamping the locating shaft in accordance with an embodiment of the present invention.

With reference to FIGS. 1, 14 and 15, the locating shaft 310 integrated to the lower die 330 is clamped by the first pushing block 120 and the second pushing block 130 to contact the mounting surface 210 of the carrier 200, the second reference surface 113*c* of the second guide portion 113 and the first reference surface 111*a* of the reference portion 111. As a result, the die set 300 fixed on the carrier 200 with shift or skew errors due to the shifted or skew locating shaft 310 will not occur, and further, damages result from the impact of die tools during automatic punching step or insufficient product productions will not occur.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A clamping mechanism coupled to a carrier of a machine and provided to clamp a locating shaft of a die set, the locating shaft including a first pushed portion and a second pushed portion which are oppositely located on a surface of the locating shaft, the clamping mechanism comprising:

a cage base fixed on the carrier and including a reference portion, a first guide portion, a second guide portion and an accommodation space, the first and second guide portions are located on both sides of the reference portion respectively, the accommodation space is located between the first and second guide portions and provided to accommodate the locating shaft, the first guide portion has a first guide opening and the second guide portion has a second guide opening, and the first and second guide openings communicate with the accommodation space respectively;

a first pushing block movably disposed in the first guide opening and including a first pushing portion, the first pushing portion is provided to push a first horizontal pushed surface of the first pushed portion of the locating shaft such that a top surface of the locating shaft contacts against a mounting surface of the carrier; and a second pushing block movably disposed in the second guide opening and including a second pushing portion, the second pushing portion is provided to push a first vertical pushed surface of the second pushed portion of the locating shaft such that a first contacting surface of the locating shaft contacts against a first reference surface of the reference portion.

2. The clamping mechanism in accordance with claim 1, wherein the first pushing portion is provided to push the first horizontal pushed surface of the first pushed portion of the locating shaft such that a second contacting surface of the locating shaft contacts against a second reference surface of the second guide portion.

3. The clamping mechanism in accordance with claim 1, wherein the first pushing portion has a first pushing curved surface and the first horizontal pushing surface is an inclined surface, the first pushing curved surface is provided to push the first horizontal pushed surface to move the locating shaft toward the carrier.

4. The clamping mechanism in accordance with claim 3, wherein the first pushing portion has a vertical relief groove provided to accommodate a second vertical pushed surface of the first pushed portion.

5. The clamping mechanism in accordance with claim 4, wherein the vertical relief groove is substantially perpendicular to the first pushing curved surface.

6. The clamping mechanism in accordance with claim 1, wherein the second pushing portion has a second pushing curved surface and the first vertical pushed surface is an inclined surface, the second pushing curved surface is provided to push the first vertical pushed surface to move the locating shaft toward the reference portion.

7. The clamping mechanism in accordance with claim 6, wherein the second pushing portion has a horizontal relief groove provided to accommodate a second horizontal pushed surface of the second pushed portion.

8. The clamping mechanism in accordance with claim 7, wherein the horizontal relief groove is substantially perpendicular to the second pushing curved surface.

9. The clamping mechanism in accordance with claim 1, wherein there is a first blocking flange in the first guide opening and the first blocking flange is provide to block a first restricting portion of the first pushing block.

10. The clamping mechanism in accordance with claim 1, wherein there is a second blocking flange in the second guide opening and the second blocking flange is provide to block a second restricting portion of the second pushing block.

11. The clamping mechanism in accordance with claim 1, wherein the first pushing block is moved toward or away from the accommodation space by a power.

12. The clamping mechanism in accordance with claim 1, wherein the second pushing block is moved toward or away from the accommodation space by a power.

13. The clamping mechanism in accordance with claim 1, wherein the first pushing portion has a first pushing curved surface and a vertical relief groove, the second pushing portion has a second pushing curved surface and a horizontal relief groove, there are a first included angle defined between the vertical relief groove and the first pushing curved surface and a second included angle defined between the horizontal relief groove and the second pushing curved surface, the first included angle is substantially equal to the second included angle.

* * * * *